US008967771B2

(12) United States Patent
Nakao

(10) Patent No.: US 8,967,771 B2
(45) Date of Patent: Mar. 3, 2015

(54) LIQUID EJECTING HEAD, LIQUID EJECTING APPARATUS AND METHOD FOR MANUFACTURING LIQUID EJECTING HEAD

(71) Applicant: Seiko Epson Corporation, Tokyo (JP)

(72) Inventor: Hajime Nakao, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/168,344

(22) Filed: Jan. 30, 2014

(65) Prior Publication Data

US 2014/0218441 A1 Aug. 7, 2014

(30) Foreign Application Priority Data

Feb. 1, 2013 (JP) ..... 2013-018383

(51) Int. Cl.

| | |
|---|---|
| ***B41J 2/14*** | (2006.01) |
| ***B41J 2/05*** | (2006.01) |
| ***B41J 2/045*** | (2006.01) |
| ***B41J 2/16*** | (2006.01) |

(52) U.S. Cl.

CPC ..... *B41J 2/1433* (2013.01); *B41J 2/1623* (2013.01)

USPC ..... 347/47; 347/65; 347/68

(58) Field of Classification Search

CPC ..... B41J 2/1404; B41J 2/1631; B41J 2/1603; B41J 2/1639; B41J 2202/11; B41J 2002/14387; B41J 2/1623; B41J 2/14233; B41J 2/14201; B41J 2/161; B41J 2/045; B41J 2002/14491; B41J 2002/14419

See application file for complete search history.

(56) References Cited

FOREIGN PATENT DOCUMENTS

| | | | |
|---|---|---|---|
| JP | 11-309877 | | 11/1999 |
| JP | 2009096104 A | * | 5/2009 |

* cited by examiner

*Primary Examiner* — Lisa M Solomon

(74) *Attorney, Agent, or Firm* — Harness, Dickey & Pierce, P.L.C.

(57) ABSTRACT

A liquid ejecting head includes a communication hole that has a first opening which communicates with a pressure chamber side where pressure is applied to a supplied liquid at one end and a second opening which communicates with a nozzle side ejecting the liquid to which the pressure is applied at the other end, and communicates the pressure chamber and the nozzle with each other, an opening area of the second opening being larger than an opening area of the first opening. An inclined surface that is directed to the second opening is provided on a side where a distance between an edge of the first opening and an edge of the second opening in the first direction is shorter than on the other end side so that stagnation in the flow of the liquid and reduction in bubble discharge are prevented and stable liquid ejection is achieved.

9 Claims, 8 Drawing Sheets

LIQUID EJECTING HEAD, LIQUID EJECTING APPARATUS AND METHOD FOR MANUFACTURING LIQUID EJECTING HEAD

BACKGROUND

1. Technical Field

The present invention relates to a liquid ejecting head, a liquid ejecting apparatus and a method for manufacturing a liquid ejecting head.

2. Related Art

As an example of a liquid ejecting head, an ink jet type recording head is known which discharges ink drops from nozzles by causing pressure change in ink in a pressure chamber that communicates with the nozzles.

In a configuration of the ink jet type recording head, a first nozzle array in which the nozzles are arranged in a constant direction and a second nozzle array in which similarly nozzles are arranged in the constant direction are arranged in a direction that is orthogonal to the constant direction so that the nozzles are placed at a higher density, and the first nozzle array and the second nozzle array are placed in a shifted manner in the constant direction (so-called staggered arrangement) (refer to JP-A-11-309877).

However, when the first nozzle array and the second nozzle array are placed in the constant direction in the so-called staggered arrangement as in JP-A-11-309877, a distance between the nozzles (pitch between the nozzles) in the constant direction is short so as to ensure flow path and partition wall dimensions which are required to form an individual flow path of each of the nozzles, and thus there is a limit to densification.

Also, when the densification is in progress after ensuring the dimensions and a margin with respect to an error during assembly of members constituting the flow path, a shape of the flow path may be complicated and, as a result, stagnation may be likely to occur in the flow of a liquid in the flow path. The stagnation may cause bubbling (reduction in bubble discharge) in the flow path, and stable liquid ejection from the nozzle may be hindered.

The above-described problem is present in not only the ink jet type recording head but also the liquid ejecting head that ejects a liquid other than the ink.

SUMMARY

An advantage of some aspects of the invention is to provide a liquid ejecting head that can prevent the stagnation and reduction in bubble discharge and achieve stable liquid ejection, a liquid ejecting apparatus, and a method for manufacturing the liquid ejecting head.

According to an aspect of the invention, a liquid ejecting head includes a pressure chamber that applies pressure to a liquid which is supplied, a nozzle that ejects the liquid to which the pressure is applied, and a communication hole that includes a first opening which communicates with the pressure chamber side at one end and a second opening which communicates with the nozzle side at the other end and has an opening area larger than an opening area of the first opening, and causes the pressure chamber and the nozzle to communicate with each other. In the communication hole, a distance between an edge of the first opening and an edge of the second opening in a first direction that is a predetermined in-plane direction of the opening area varies on one end side and the other end side in the first direction. The communication hole further includes an inclined surface that is directed to the second opening on the side where the distance between the edge of the first opening and the edge of the second opening is shorter than on the other end side in the first direction.

According to this configuration, the flow of the liquid in the communication hole and bubble discharge are improved by the presence of the inclined surface, and stable liquid ejection is achieved. Also, in the communication hole, the opening area of the second opening that communicates with the nozzle side is ensured to be larger than the opening area of the first opening that communicates with the pressure chamber side, and thus positioning of the communication hole and the nozzle is facilitated even when the pressure chamber and the nozzle are densified (margin with respect to an error in the positioning of the communication hole and the nozzle is ensured).

The inclined surface may be formed by various methods. As one of such examples, the inclined surface may be formed by a part of an adhesive that adheres the members constituting the liquid ejecting head with each other.

According to this configuration, the inclined surface is formed while the members constituting the liquid ejecting head are adhered with each other, and thus a configuration including the inclined surface can be achieved with ease.

According to the aspect of the invention, in the second opening, a width in the second direction that is orthogonal to the first direction may be set to be smaller than a width of the pressure chamber on the side where the distance between the edge of the first opening and the edge of the second opening in the first direction is shorter than on the other end side, and, in the second opening, a width in the second direction may be set to be larger than the width of the pressure chamber on the side where the distance between the edge of the first opening and the edge of the second opening in the second direction is longer than on the other end side.

According to this configuration, the second opening has a portion that has the width which is smaller than the width of the pressure chamber in the second direction and a portion that has the width which is larger than the width of the pressure chamber in the second direction, and thus contributes greatly to the densification of the pressure chamber and the nozzle.

Specifically, the liquid ejecting head may further include a nozzle plate in which a first nozzle array where a plurality of the nozzles are formed in the second direction and a second nozzle array where a plurality of the nozzles are formed in the second direction are arranged in the first direction and the nozzles of the first nozzle array and the nozzles of the second nozzle array are formed at positions different in the second direction, and a flow path member that includes a plurality of the pressure chambers which are arranged in the second direction and a plurality of the communication holes that cause the respective pressure chambers to communicate one-to-one with the respective nozzles. In the second opening of each of the plurality of the communication holes, portions of the second opening that have the width larger than the width of the pressure chamber which is placed in the first direction may be alternately placed at different positions in the second direction with respect to the first opening, and may communicate alternately with the nozzles of the first nozzle array and the nozzles of the second nozzle array in the second direction.

According to this configuration, the second openings of the communication holes are alternately disposed at the positions different in the first direction, and thus the communication holes can be placed at narrow intervals in the second direction so as to contribute to the densification of the nozzle in the second direction and reduction in size of the head.

The technical idea according to the invention may be embodied by various forms not limited to the liquid ejecting head. For example, an apparatus (liquid ejecting apparatus) mounted with the liquid ejecting head can be regarded as one invention, and a part of the configuration of the liquid ejecting head (for example, the flow path member including the communication hole) can be regarded as one invention. Also, a method for manufacturing the above-described liquid ejecting head can be regarded as one invention. For example, a method for manufacturing a liquid ejecting head including a flow path member that includes a liquid flow path which has a first opening and a second opening which is on a side opposite to the first opening and has an opening area larger than an opening area of the first opening, an adhesion member that is adhered to the second opening side of the flow path member, and a nozzle that ejects a liquid includes applying or attaching an adhesive to at least one of a surface of the flow path member on the adhesion member side and a surface of the adhesion member on the flow path member side, and forming an inclined surface that is directed from a wall surface of the flow path to the second opening by causing a part of the adhesive to enter the flow path from the second opening on a side where a distance between an edge of the first opening and an edge of the second opening is shorter than on the other end side in the first direction which is parallel with an opening surface of the second opening by adhering the flow path member and the adhesion member with each other and by using the adhesive that enters the flow path.

BRIEF DESCRIPTION OF THE DRAWINGS

The invention will be described with reference to the accompanying drawings, wherein like numbers reference like elements.

FIG. 4 is a view illustrating a part of a plurality of pressure chambers and the like.

DESCRIPTION OF EXEMPLARY EMBODIMENTS

Hereinafter, embodiments of the invention will be described referring to the accompanying drawings.

Figure 1:
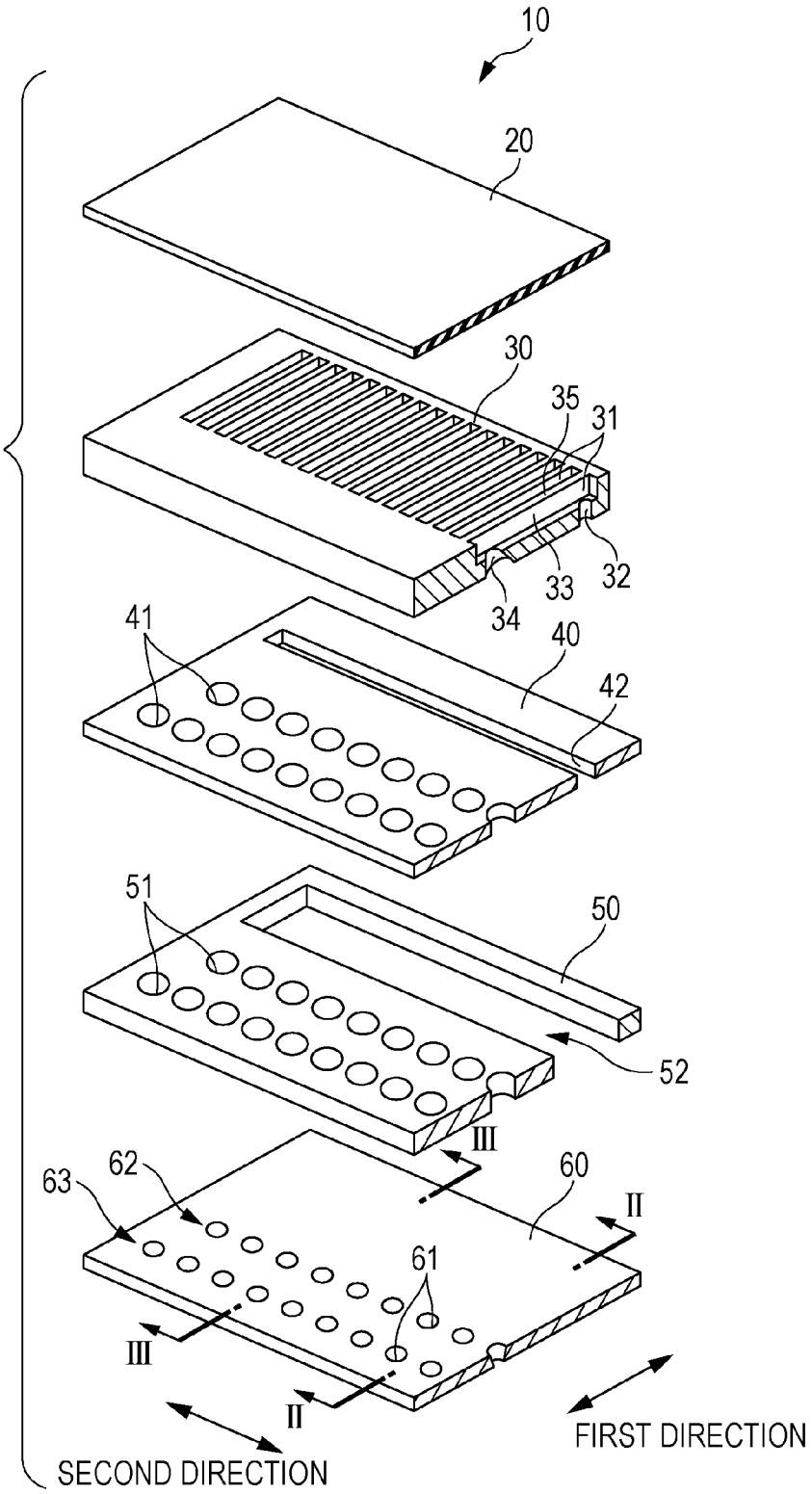
FIG. 1 is an exploded perspective view illustrating a part of a main configuration of a liquid ejecting head.

FIG. 1 is an exploded perspective view illustrating a part of a main configuration of a liquid ejecting head 10 according to this embodiment. Herein, an ink jet type recording head that ejects (discharges) ink is described as the liquid ejecting head 10. The liquid ejecting head 10 is configured to include each of the following members of a vibrating plate 20, a flow path substrate 30, a sealing plate 40, a reservoir plate 50, and a nozzle plate 60. The flow path substrate 30 corresponds to an example of a flow path member according to an aspect of the invention. These members may be individually formed and stacked or these members (or some of these members) may be integrally formed. Also, the liquid ejecting head 10 may be configured to include a member other than the members shown in FIG. 1 or may be configured not to include some of the members shown in FIG. 1.

The vibrating plate 20 seals one surface of the flow path substrate 30, and is mounted with a piezoelectric element 70 (refer to FIGS. 2 and 3) on a surface on the side opposite to a surface in contact with the flow path substrate 30. The vibrating plate 20 is formed of ceramics or the like or the vibrating plate 20 has, for example, an elastic film formed of an oxide film which is in contact with the flow path substrate 30 and an insulator film which is formed from an oxide film using a different material than the elastic film and is stacked on the elastic film. In the invention, objects being "in contact" with each other means both of a state where an adhesive or the like is interposed between the objects and a state where nothing is interposed between the objects.

The flow path substrate 30 has a plurality of liquid flow paths 31. The flow paths 31 are arranged in a second direction that is orthogonal to a first direction which is parallel with a longitudinal direction thereof. A partition wall 35 is disposed between the flow path 31 and the flow path 31. In this specification, directions, positions and the like of the components of the liquid ejecting head 10 being expressed to be, for example, parallel, orthogonal, or identical to each other means not only that these are strictly parallel, orthogonal, or identical to each other but also that these are with a tolerance acceptable for product performance and a tolerance acceptable in product manufacturing.

Each of the flow paths 31 is configured to have a supply hole 32, a pressure chamber 33, and a communication hole 34. The pressure chamber 33 is open on the one surface of the flow path substrate 30, and the supply hole 32 and the communication hole 34 are open on the other surface of the flow path substrate 30. The supply hole 32 communicates with the pressure chamber 33 in the vicinity of one longitudinal direction end side of the pressure chamber 33. The communication hole 34 communicates with the pressure chamber 33 in the vicinity of the other longitudinal direction end side of the pressure chamber 33.

The nozzle plate 60 has a plurality of nozzles 61 as through-holes through which the ink is ejected. In the example of FIG. 1, the nozzle plate 60 has a first nozzle array 62 where the plurality of nozzles 61 are formed at predetermined intervals along the second direction, and a second nozzle array 63 where the plurality of nozzles 61 are formed at the predetermined intervals along the second direction. The first nozzle array 62 and the second nozzle array 63 are arranged in the first direction. Also, the nozzles 61 of the first nozzle array 62 and the nozzles 61 of the second nozzle array 63 are placed at positions shifted in the second direction (so-called staggered arrangement). In a case where the first nozzle array 62 and the second nozzle array 63 are collectively considered as one nozzle group (nozzle group of the liquid ejecting head 10), a nozzle pitch P (distance between the nozzles in the second direction) of the nozzle group is half of the predetermined interval.

Each of the communication holes 34 of the respective flow paths 31 causes each of the pressure chambers 33 and each of the nozzles 61 to communicate one-to-one with each other. In the example of FIG. 1, the sealing plate 40 and the reservoir plate 50 are interposed between the other surface of the flow path substrate 30 and the nozzle plate 60. One surface of the sealing plate 40 is in contact with the other surface of the flow path substrate 30. One surface of the reservoir plate 50 is in contact with the other surface of the sealing plate 40. Also, the other surface of the reservoir plate 50 is in contact with the surface of the nozzle plate 60 on the side opposite to a surface thereof which is exposed to the outside (nozzle opening surface). Each of the flow path substrate 30, sealing plate 40, reservoir plate 50, and nozzle plate 60 is formed of, for example, ceramics, a silicon single crystal substrate, and stainless steel.

The reservoir plate 50 has a plurality of second communication holes 51 and a reservoir 52. The reservoir 52 is referred to as a common ink chamber. Both of the second communication holes 51 and the reservoir 52 penetrate the reservoir plate 50. Each of the second communication holes 51 is placed at a position corresponding one-to-one to each of the nozzles 61. The length of the reservoir 52 in the second direction is ensured in such a manner as to substantially correspond to the length of the nozzle group in the second direction. The sealing plate 40 has a plurality of first communication holes 41 and a common supply hole 42. Both of the first communication holes 41 and the common supply hole 42 penetrate the sealing plate 40. Each of the first communication holes 41 is placed at a position corresponding one-to-one to each of the nozzles 61 as is the case with each of the second communication holes 51. Also, each of the first communication holes 41 communicates one-to-one with each of the communication holes 34. The length of the common supply hole 42 in the second direction is ensured in such a manner as to substantially correspond to the length of the nozzle group in the second direction as is the case with the reservoir 52. Also, the common supply hole 42 communicates with each of the supply holes 32 of the respective flow paths 31. (Excluding an ink supply path from the outside that will be described later,) the reservoir 52 is sealed by the nozzle plate 60 on a side in contact with the nozzle plate 60, and is sealed by the sealing plate 40 on a side in contact with the sealing plate excluding a portion which corresponds to the common supply hole 42.

Figure 2:
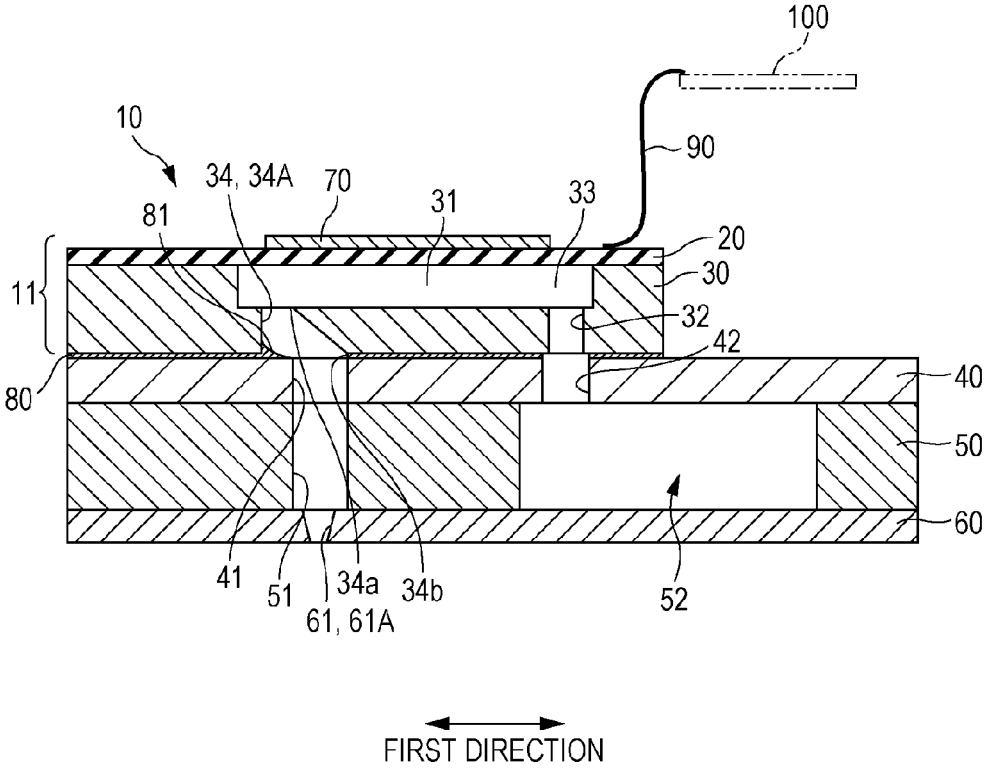
FIG. 2 is a cross-sectional view showing a cross section through a nozzle of a first nozzle array.

FIG. 2 shows a cross section taken along line II-II' of the liquid ejecting head 10 shown in FIG. 1 from a point of view facing the second direction. The cross section shown in FIG. 2 is a cross section through the nozzles 61 of the first nozzle array 62.

Figure 3:
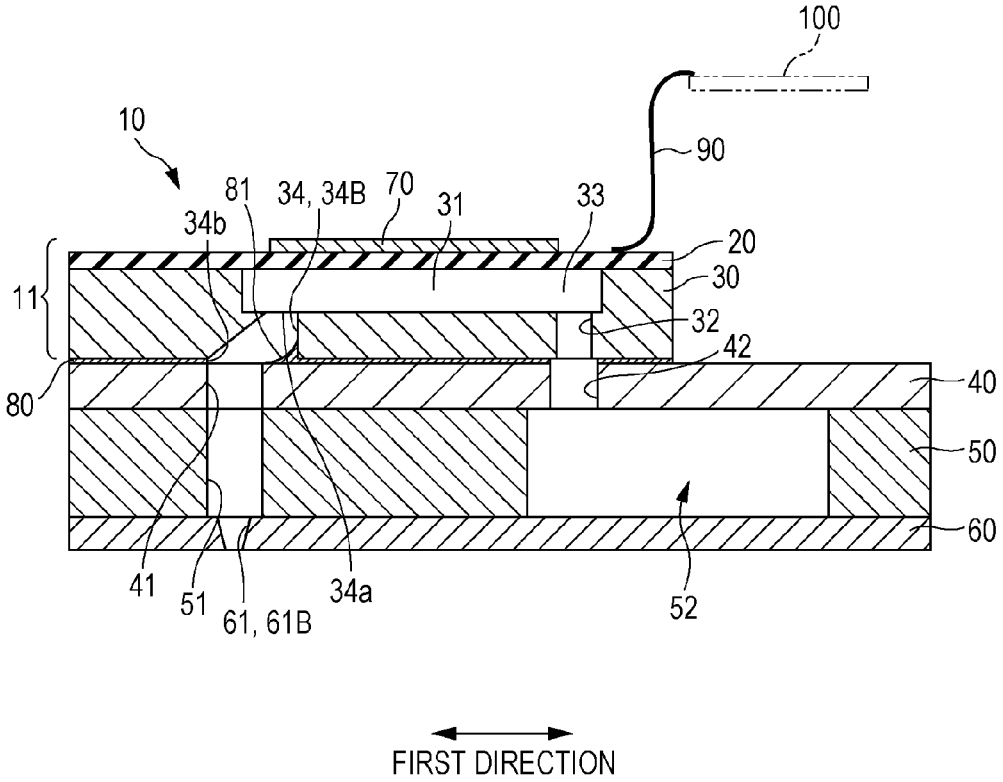
FIG. 3 is a cross-sectional view showing a cross section through a nozzle of a second nozzle array.

FIG. 3 shows a cross section taken along line III-III' of the liquid ejecting head 10 shown in FIG. 1 from a point of view facing the second direction. The cross section shown in FIG. 3 is a cross section through the nozzles 61 of the second nozzle array 63.

As shown in FIGS. 2 and 3, the pressure chamber 33 communicates with the nozzles 61 via the communication holes 34, first communication holes 41, and the second communication holes 51. The communication hole 34 that is shown in FIG. 2 causes the pressure chamber 33 to communicate with the nozzle 61 of the first nozzle array 62, and the communication hole 34 that is shown in FIG. 3 causes the pressure chamber 33 to communicate with the nozzle 61 of the second nozzle array 63. Hereinafter, the nozzle 61 of the first nozzle array 62 may be referred to as a nozzle 61A, the nozzle 61 of the second nozzle array 63 may be referred to as a nozzle 61B, the communication hole 34 that causes the pressure chamber 33 to communicate with the nozzle 61A may be referred to as a communication hole 34A, and the communication hole 34 that causes the pressure chamber 33 to communicate with the nozzle 61B may be referred to as a communication hole 34B to allow for the difference.

The piezoelectric element 70 is mounted on the surface of the vibrating plate 20 on the side opposite to the surface in contact with the flow path substrate 30. As is known, the piezoelectric element 70 is disposed on each of the pressure chambers 33 to correspond to positions of the pressure chambers 33. An individual electrode and a common electrode, which are not shown herein, are connected to the piezoelectric element 70, and the piezoelectric element 70 is deformed when voltage supplied from the circuit substrate 100 which drives the liquid ejecting head 10 is applied via cables (flexible substrate or the like) 90 to the electrodes. The vibrating plate 20 on which the piezoelectric element 70 and each of the above-described electrodes are mounted and the flow path substrate 30 can be collectively referred to as an actuator substrate 11.

The ink is supplied from the outside to the reservoir 52 via the ink supply path that is not shown herein. The ink that is supplied to the reservoir 52 passes through the common supply hole 42 and is supplied to each of the pressure chambers 33 from each of the supply holes 32. The above-described deformation of the piezoelectric element 70 causes the vibrating plate 20 to be bent and pressure in the pressure chamber 33 to increase. The ink in the pressure chamber 33 is ejected from the nozzles 61 in response to the increase in the pressure.

As shown in FIGS. 2 and 3, the communication hole 34 has a first opening 34*a* that communicates with a pressure chamber 33 side at one end, and a second opening 34*b* that communicates with a nozzle 61 side at the other end. In this embodiment, the opening area of the second opening 34*b* is ensured to be larger than the opening area of the first opening 34*a*. In this embodiment, an in-plane direction that constitutes the opening areas includes the first direction.

Figure 4:
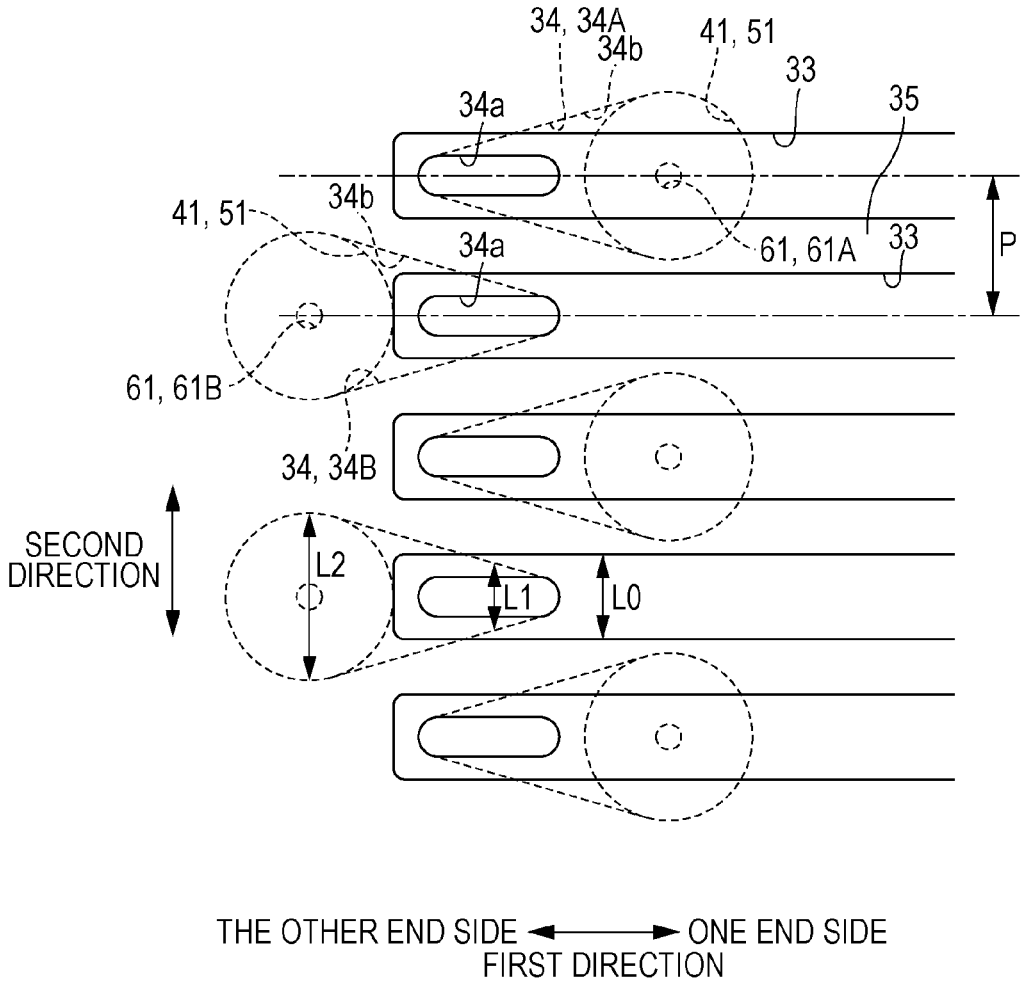

FIG. 4 illustrates a part of the plurality of pressure chambers 33 and the like from a point of view from a vibrating plate 20 side. In FIG. 4, the pressure chamber 33 and the first opening 34*a* are shown with a solid line, and the second opening 34*b* is shown with a chain line. Also, for reference, the first communication hole 41, the second communication hole 51, and the nozzle 61 that communicate with the second opening 34*b* are also shown with a chain line. It can be known also in FIG. 4 that the second opening 34*b* is formed to be larger than the first opening 34*a*. The first openings 34*a* are placed in such a manner as to have the same positions in the first direction. Also, in each of the communication holes 34, a distance between an edge of the first opening 34*a* and an edge of the second opening 34*b* in the first direction that is parallel with opening surfaces of the first opening 34*a* and the second opening 34*b* varies on one end side and the other end side in the first direction. Specifically, in the communication hole 34B, the distance between the edge of the first opening 34*a* and the edge of the second opening 34*b* on the one end side is short (almost zero in the example of FIG. 4), and the distance between the edge of the first opening 34*a* and the edge of the second opening 34*b* on the other end side is long. In contrast, in the communication hole 34A, the distance between the edge of the first opening 34*a* and the edge of the second opening 34*b* on the other end side is short (almost zero in the example of FIG. 4), and the distance between the edge of the first opening 34*a* and the edge of the second opening 34*b* on the one end side is long.

Further, the second opening 34*b* of each of the communication holes 34 has a width L1 that is smaller than a width L0 of the pressure chamber 33 in the second direction on the side where the distance between the edge of the first opening 34*a* and the edge of the second opening 34*b* in the first direction is short, and has a width L2 that is larger than the width L0 of the pressure chamber 33 in the second direction on the side where the distance between the edge of the first opening 34*a* and the edge of the second opening 34*b* in the first direction is long. Further, portions of the second openings 34*b* of the communication holes 34 that have the width which is larger than the width of the pressure chamber 33 are placed alternately along the second direction at different positions with respect to the first openings 34*a* in the first direction. This means that the communication holes 34A and the communication holes 34B are placed alternately in the second direction in a shape that is symmetrical with a line in the second direction which passes through centers of the first openings 34*a*.

When the above-described shape and placement of the communication holes 34 are adopted, the communication holes (communication hole 34A and communication hole 34B) associated with the adjacent pressure chambers 33 do not interfere with each other, and thus the pressure chambers 33 can be placed at a high density in the second direction and the nozzles 61 can be placed at a high density in the second direction (the nozzle pitch P can be narrower). Also, even when the pressure chambers 33 are placed at a high density, the second opening 34*b* of the communication hole 34 has the portion wider than the pressure chamber 33 (refer to L2 of FIG. 4), and thus positioning of the nozzle 61 (furthermore, the first communication hole 41 and the second communication hole 51) and the communication hole 34 can be facilitated.

As is shown from the above description and FIGS. 2 to 4, the second opening 34*b* of the communication hole 34 communicates with the nozzle 61 side at the portion that is wider than the pressure chamber 33. This configuration, in other words, means that a partial range of the second opening 34*b* (range including the portion that is narrower (refer to L1 of FIG. 4) than the pressure chamber 33) is blocked by a member (sealing plate 40 in the example of FIGS. 1 to 3) that is in contact with a surface of the flow path substrate 30 on a side where the second opening 34*b* is open. In the partial range that is blocked by the member which is in contact with the surface on the side where the second opening 34*b* is open in this manner, a step portion is formed by the contact member and a wall surface of the communication hole 34. The step portion may cause stagnation of the flow of the ink and bubbling (reduction in bubble discharge) in the flow path and may hinder stable liquid ejection from the nozzle 61. As such, in this embodiment, the communication hole 34 has an inclined surface 81 (refer to FIGS. 2 and 3) toward the second opening on the side where the distance between the edge of the first opening 34*a* and the edge of the second opening 34*b* in the first direction is short so as to eliminate the presence of the step portion to the maximum extent possible.

Figure 5:
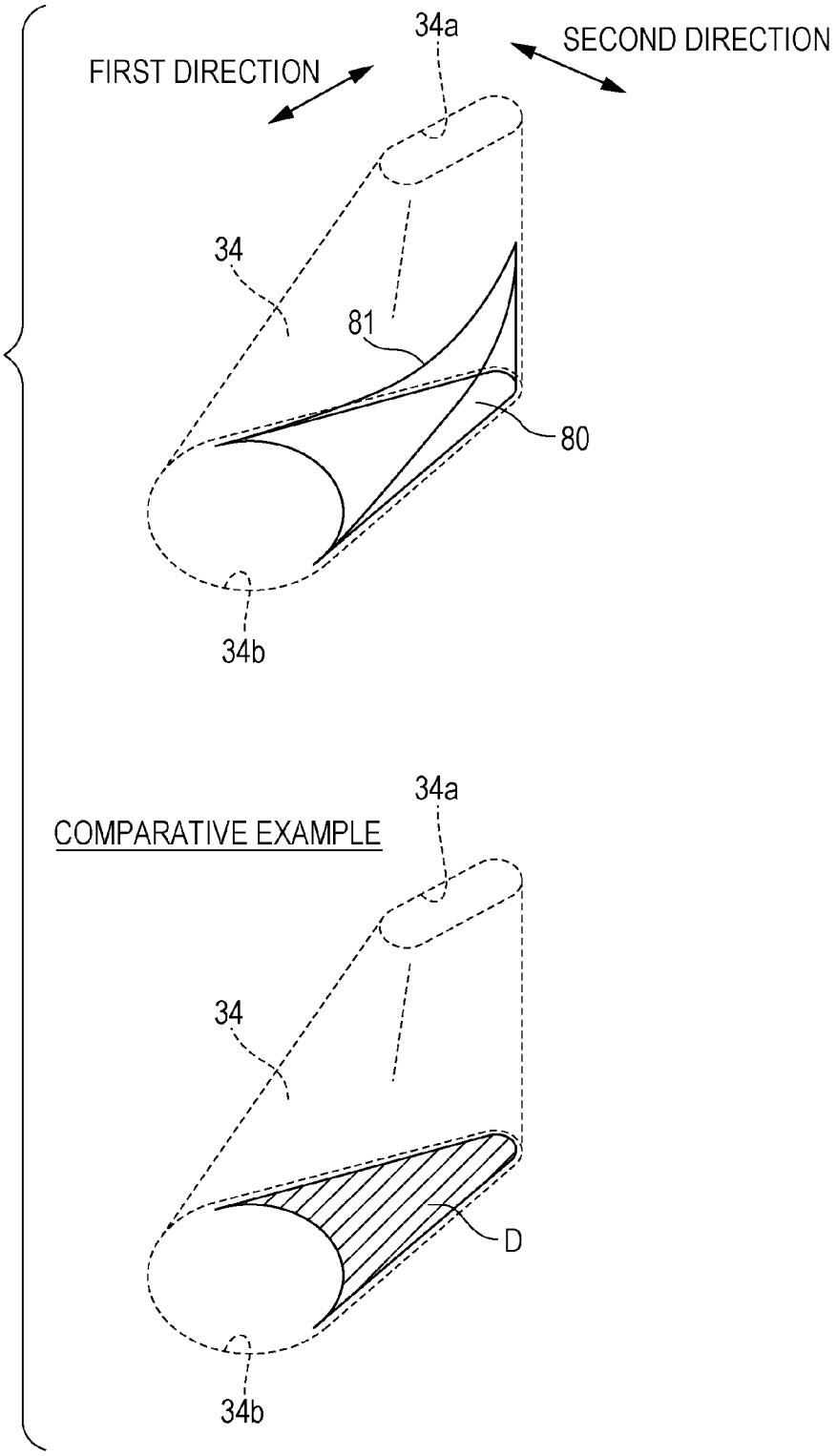
FIG. 5 is a perspective view illustrating a communication hole that has an inclined surface therein.

FIG. 5 is a perspective illustration of the communication hole 34 that has the inclined surface 81 on the wall surface therein. In FIG. 5, the wall surface (side surface) of the hole of the communication hole 34 is shown with a chain line, and the inclined surface 81 is shown with a solid line. Also, FIG. 5 shows the communication hole 34 that does not have the inclined surface 81 on the wall surface (side surface) therein as a comparative example of this embodiment. A range of the comparative example that is shown with sign D is the above-described partial range of the second opening 34*b*, and the step portion is formed in this range between the wall surface (side surface) of the communication hole 34 and the surface of the sealing plate which is adhered. According to FIG. 5, the inclined surface 81 that is inclined from the wall surface (side surface) is formed at a position corresponding to the step portion in such a manner that the step portion is buried, and thus the presence of the step portion is substantially eliminated. In this embodiment, the inclined surface 81 is not only a surface inclined with respect to a normal direction but also an inclined surface that is inclined with respect to the wall surface (side surface) which is adjacent to the edge of the first opening 34*a*. The flow of the ink in the communication hole 34 is improved by the presence of the inclined surface 81, and the bubbling in the communication hole 34 is also prevented. As a result, the bubble discharge out of the nozzle 61 is improved, and the liquid ejection from the nozzle 61 becomes more stable than in the related art.

The inclined surface 81 may be formed by various methods. In this embodiment, as one of such examples, the inclined surface 81 is formed by a part of an adhesive that adheres the members constituting the liquid ejecting head 10 with each other. Specifically, the inclined surface 81 is formed by a part of a layer (adhesion layer 80) of the adhesive that adheres the surface of the flow path substrate 30 on the side where the second opening 34*b* is open with the member (sealing plate 40 in the example of FIGS. 1 to 3) which is in contact with the surface. However, at least a part of the inclined surface 81 may be formed by a material other than the adhesive and the member. Also, the wall surface (side surface) of the communication hole 34 itself may be formed in the flow path substrate 30 with a shape that has the inclined surface 81 which is inclined with respect to the normal direction.

Hereinafter, a method used in a case where the inclined surface 81 is formed by a part of the adhesion layer 80 will be described.

Figure 6:
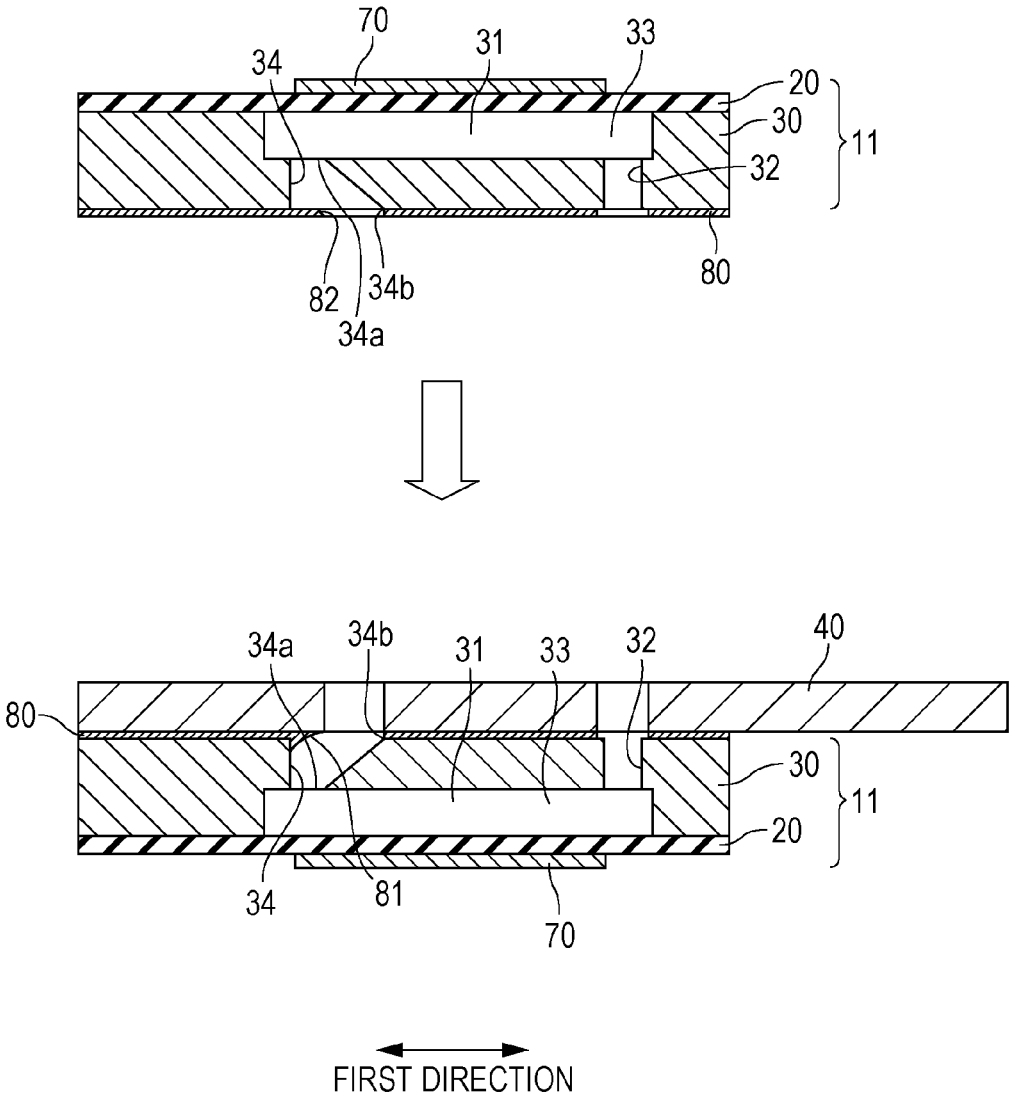
FIG. 6 is a view illustrating a part of a method for manufacturing the liquid ejecting head.

FIG. 6 illustrates each of processes through which the inclined surface 81 is formed, which are included in a method for manufacturing the liquid ejecting head 10, by using the same cross section as in FIG. 2. The upper section of FIG. 6 shows applying or attaching the adhesive to the surface (hereinafter, target surface) of the flow path substrate 30 on the side where the second opening 34*b* is open. Specifically, a sheet-like thermo-compression adhesive (adhesion sheet) is attached to the target surface. The adhesion sheet is an example of the adhesion layer 80.

Figure 7:
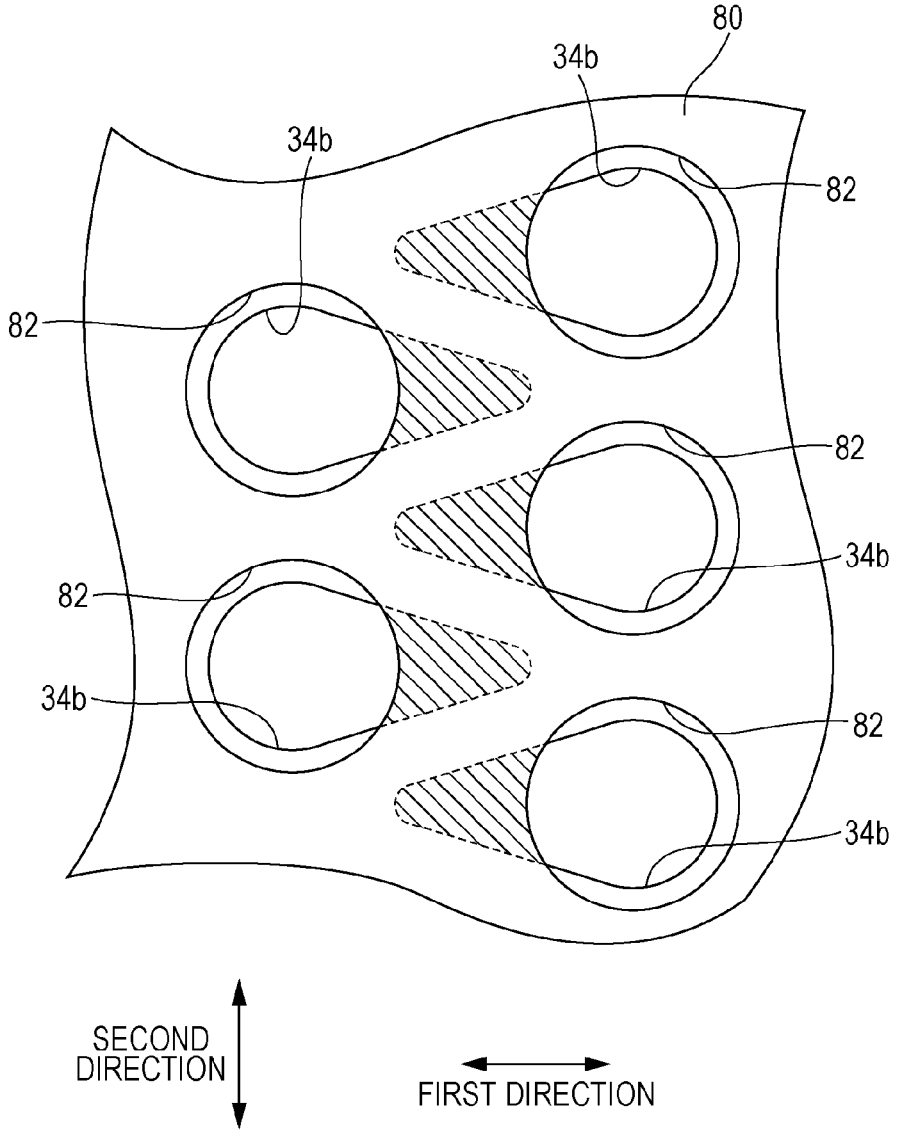
FIG. 7 is a view illustrating the vicinity of a plurality of second openings in a state where an adhesion sheet is attached to a target surface.

FIG. 7 illustrates the vicinity of the plurality of second openings 34*b* in a state where the adhesion sheet (80) is attached to the target surface. A substantially circular hole 82 that corresponds to the position of each of the second openings 34*b* is formed in advance through hollowing out on the adhesion sheet (80). The adhesion sheet (80) is attached in such a manner that each of the holes 82 surrounds an outer side of the portion of each of the second openings 34*b* which is wider than the pressure chamber 33. However, the adhesion sheet (80) does not completely surround the outer side of each of the second openings 34*b* with each of the holes 82, but a partial range of each of the second openings 34*b* is covered by the adhesion sheet (80). The range shown with an oblique line in FIG. 7 is the range of each of the second openings 34*b* that is covered by the adhesion sheet (80).

After the adhesion sheet (80) is attached to the target surface as described above, the actuator substrate 11 is placed in such a manner that the target surface is directed to a vertical direction upper side as shown in the lower section of FIG. 6, the member (the member that is in contact with the target surface is referred to as an adhesion member: sealing plate 40 in the example of FIGS. 1 to 3 and 6) that is contact with the target surface is pressed against the adhesion sheet (80), and heat is applied to the adhesion sheet (80). In this manner, the target surface and the adhesion member are thermo-compressed. In this case, the portion covering the range shown with the oblique line in FIG. 7 that is a part of the adhesion sheet (80) which is temporarily softened by the heat enters the flow path (communication hole 34) from the second opening 34*b* for the pressure caused by the pressing of the adhesion member and gravity. The portion of the adhesion sheet (80) that enters the flow path is cooled and cured while moving along the wall surface corresponding to the portion of the communication hole 34 which is narrower than the pressure chamber 33. As a result, as shown in the lower section of FIG. 6 and FIGS. 2, 3, and 5, the inclined surface 81 that has a shape directed from the wall surface of the communication hole 34 to the second opening 34*b* is shaped by the adhesive which is hardened. In a case where the adhesive is not a thermo-compression adhesive, the heat may not be applied but the adhesion is performed by a method corresponding thereto.

A timing when the actuator substrate 11 is placed in such a manner that the target surface is directed to the vertical direction upper side may be earlier than a timing of attaching the adhesion sheet (80) to the target surface. Also, the adhesion sheet (80) may not be attached to the target surface but may be attached a surface (hereinafter, second target surface) of the adhesion member (sealing plate 40 in the example of FIGS. 1 to 3 and 6) in contact with the target surface on a flow path substrate 30 side. Further, the adhesion sheet (80) may be attached to both of the target surface and the second target surface. Even in this case, it is preferable that the adhesion be performed by placing the actuator substrate 11 in such a manner that the target surface is directed to the vertical direction upper side. Then, the reservoir plate 50 and the nozzle plate 60 are mounted, and connected to the circuit substrate 100 or the like so that the liquid ejecting head 10 is manufactured. According to the manufacturing method, the inclined surface 81 can be easily formed by the originally required material of the adhesive.

Other Embodiments

The invention is not limited to the above-described embodiment, but various modifications are possible without departing from the scope of the invention. For example, the following embodiments are also possible.

The liquid ejecting head 10 does not necessarily have to include the sealing plate 40 and the reservoir plate 50, but may include another plate such as a so-called compliance plate. Further, the liquid ejecting head 10 may be configured to include a plurality of these plates or may be configured to include a single plate which has functions of the plurality of plates. Also, the nozzle plate 60 and the so-called compliance plate may be adhered to the target surface. In this case, for example, a configuration in which the flow path substrate 30 has a part of the reservoir which supplies the ink to each of the pressure chambers 33 may be adopted.

Also, pressure generation means for generating a change in the pressure in the pressure chamber 33 is not limited to the thin film type piezoelectric element shown in FIGS. 2, 3, and 6 but, for example, a stacked type piezoelectric actuator in which a piezoelectric material and an electrode material are alternately stacked or longitudinal vibration type pressure generation means that applies a change in pressure to each of the pressure chambers 33 through longitudinal vibration may be adopted. Also, one in which a heating element is placed in a pressure chamber and ejects droplets from a nozzle by using bubbles generated by heat generation of the heating element or such as a so-called electrostatic actuator that generates static electricity between a vibrating plate and an electrode, deforms the vibrating plate by using the static electricity, and ejects droplets from a nozzle can be used as the pressure generation means.

Also, the liquid ejecting head 10 constitutes a part of an ink jet type recording head unit that includes an ink supply path which communicates with an ink cartridge or the like, and is mounted on an ink jet printer 200. The ink jet printer 200 is an example of a liquid ejecting apparatus.

Figure 8:
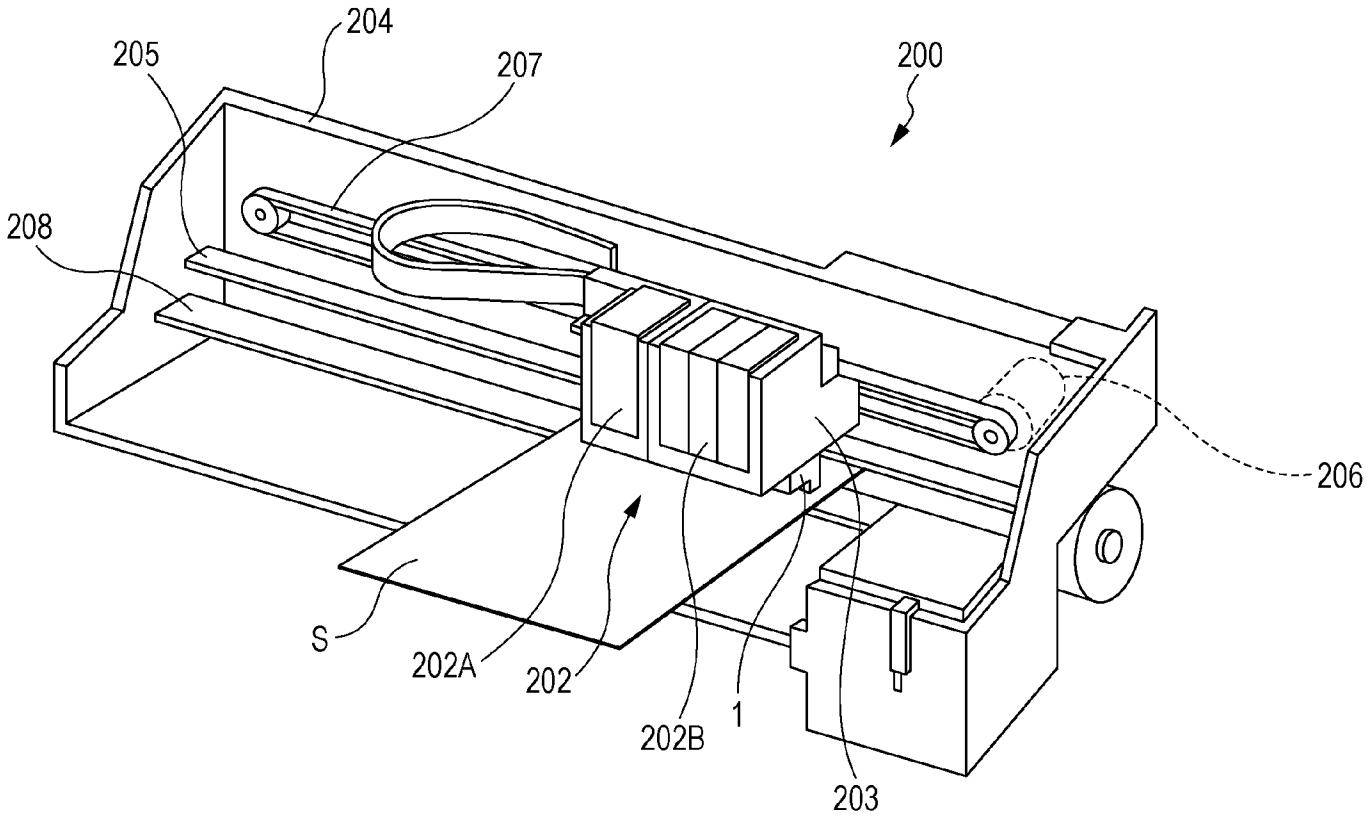
FIG. 8 is a schematic view showing an example of an ink jet printer.

FIG. 8 is a schematic view showing an example of the ink jet printer 200. Sign 1 in FIG. 8 shows a part of a housing (head cover) that accommodates the liquid ejecting head 10 while exposing a nozzle opening surface thereof to the outside. In the ink jet printer 200, ink cartridges 202A and 202B or the like are removably disposed in the ink jet type recording head unit (hereinafter, head unit 202) which includes a plurality of the liquid ejecting heads 10. A carriage 203 on which the head unit 202 is mounted is disposed in an axially movable manner in a carriage shaft 205 mounted on an apparatus main body 204. When a driving force of a drive motor 206 is transmitted to the carriage 203 via a plurality of gears, which are not shown herein, and a timing belt 207, the carriage 203 moves along the carriage shaft 205.

A platen 208 is disposed along the carriage shaft 205 in the apparatus main body 204, and a printing medium S that is supplied by a roller or the like, which is not shown herein, is transported on the platen 208. The ink is ejected from the nozzle 61 of the liquid ejecting head 10 onto the printing medium S that is transported so that any image is printed onto the printing medium S. The ink jet printer 200 may be a so-called line head type printer in which not only the head unit 202 is moved as described above but also, for example, printing is performed by moving only the printing medium S with the liquid ejecting head 10 being fixed.

Also, the invention can also be applied to a liquid ejecting head and a liquid ejecting apparatus ejecting a liquid other than ink. Examples of the liquid ejecting head include a color material ejecting head that is used for manufacturing a color filter of a liquid crystal display or the like, an electrode material ejecting head that is used for forming an electrode of an organic EL display or a field emission display (FED), and a bio-organic material ejecting head that is used for biochip manufacturing. The invention can also be applied to a liquid ejecting apparatus on which the liquid ejecting head is mounted.

The entire disclosure of Japanese Patent Application No. 2013-018383, filed Feb. 1, 2013 is incorporated by reference herein.

What is claimed is:

1. A liquid ejecting head comprising:

a pressure chamber that applies pressure to a liquid which is supplied;

a nozzle that ejects the liquid to which the pressure is applied; and a communication hole that includes a first opening which communicates with the pressure chamber side at one end and a second opening which communicates with the nozzle side at the other end and has an opening area larger than an opening area of the first opening, and causes the pressure chamber and the nozzle to communicate with each other, wherein, in the communication hole, a distance between an edge of the first opening and an edge of the second opening in a first direction that is a predetermined in-plane direction of the opening area varies on one end side and the other end side in the first direction, and wherein the communication hole further includes an inclined surface that is directed to the second opening on the side where the distance between the edge of the first opening and the edge of the second opening is shorter than on the other end side in the first direction.

2. The liquid ejecting head according to claim 1, wherein the inclined surface is formed by a part of an adhesive that adheres members constituting the liquid ejecting head with each other.

3. The liquid ejecting head according to claim 1, wherein, in the second opening, a width in the second direction that is orthogonal to the first direction is set to be smaller than a width of the pressure chamber on the side where the distance between the edge of the first opening and the edge of the second opening in the first direction is shorter than on the other end side, and wherein, in the second opening, a width in the second direction is set to be larger than the width of the pressure chamber on the side where the distance between the edge of the first opening and the edge of the second opening in the first direction is longer than on the other end side.

4. The liquid ejecting head according to claim 3, further comprising:

a nozzle plate in which a first nozzle array where a plurality of the nozzles are formed in the second direction and a second nozzle array where a plurality of the nozzles are formed in the second direction are arranged in the first direction and the nozzles of the first nozzle array and the nozzles of the second nozzle array are formed at positions different in the second direction; and a flow path member that includes a plurality of the pressure chambers which are arranged in the second direction and a plurality of the communication holes that cause the respective pressure chambers to communicate one-to-one with the respective nozzles, wherein, in the second opening of each of the plurality of the communication holes, portions of the second opening that have the width larger than the width of the pressure chamber which is placed in the first direction are alternately placed at different positions in the second direction with respect to the first opening, and communicate alternately with the nozzles of the first nozzle array and the nozzles of the second nozzle array in the second direction.

5. A liquid ejecting apparatus mounted with the liquid ejecting head according to claim 1.

6. A liquid ejecting apparatus mounted with the liquid ejecting head according to claim 2.

7. A liquid ejecting apparatus mounted with the liquid ejecting head according to claim 3.

8. A liquid ejecting apparatus mounted with the liquid ejecting head according to claim 4.

9. A method for manufacturing a liquid ejecting head including a flow path member that includes a liquid flow path which has a first opening and a second opening which is on an side opposite to the first opening and has an opening area larger than an opening area of the first opening, an adhesion member that is adhered to the second opening side of the flow path member, and a nozzle that ejects a liquid, the method comprising:

applying or attaching an adhesive to at least one of a surface of the flow path member on the adhesion member side and a surface of the adhesion member on the flow path member side; and forming an inclined surface that is directed from a wall surface of the flow path to the second opening by causing a part of the adhesive to enter the flow path from the second opening on a side where a distance between an edge of the first opening and an edge of the second opening is shorter than on the other end side in the first direction which is parallel with an opening surface of the second opening by adhering the flow path member and the adhesion member with each other and by using the adhesive that enters the flow path.

* * * * *